US005649660A

United States Patent [19]

Akiba et al.

[11] Patent Number: 5,649,660

[45] Date of Patent: Jul. 22, 1997

[54] NAIL GUN HAVING SHARPSHOOTING TAPERED END

[75] Inventors: Yoshitaka Akiba; Kunio Yamamoto, both of Katsuta, Japan

[73] Assignee: Hitachi Koki Co., Ltd., Tokyo, Japan

[21] Appl. No.: 310,087

[22] Filed: Sep. 22, 1994

[30] Foreign Application Priority Data

Sep. 22, 1993 [JP] Japan ..... 5-236746
Apr. 22, 1994 [JP] Japan ..... 6-084823

[51] Int. Cl.[6] ..... B25C 1/04; B25C 1/06

[52] U.S. Cl. ..... 227/8; 227/123

[58] Field of Search ..... 227/8, 121, 132, 227/146, 147, 123

[56] References Cited

U.S. PATENT DOCUMENTS

| | | | |
|---|---|---|---|
| 3,467,294 | 9/1969 | Fisher | 227/8 |
| 3,519,186 | 7/1970 | Volkman | 227/8 |
| 3,713,573 | 1/1973 | Fehrs | 227/8 |
| 3,853,257 | 12/1974 | Perkins | 227/8 |
| 4,351,464 | 9/1982 | Fehrs et al. | 227/7 |
| 5,263,626 | 11/1993 | Howard et al. | 227/8 |
| 5,350,103 | 9/1994 | Monacelli | 227/123 |
| 5,368,213 | 11/1994 | Massari, Jr. | 227/123 |

FOREIGN PATENT DOCUMENTS

| | | |
|---|---|---|
| 2443544 | 3/1976 | Germany . |
| 7910544 | 7/1982 | Germany . |
| 3715293 | 12/1988 | Germany . |
| 53-11432 | 3/1978 | Japan . |

*Primary Examiner*—Rinaldi I. Rada
*Assistant Examiner*—Boyer Ashley
*Attorney, Agent, or Firm*—Sughrue, Mion, Zinn, Macpeak & Seas

[57] ABSTRACT

A sharpshooting nail gun capable of driving a nail into an intended spot. The nail gun includes a bit guide having an injection groove through which a nail and a drive bit pass. A contact arm is movably supported to the bit guide. The contact arm has a lower tapered end portion abuttable against a wall or attachment member, and an upper portion engageable with a trigger. When the contact arm is biased toward the wall, the upper portion is disengaged from the trigger for allowing the trigger to be manipulatable. The lower portion of the contact arm protrudes from a lower end of the bit guide, and is provided with an injection bore extending in alignment with the injection groove.

12 Claims, 7 Drawing Sheets

NAIL GUN HAVING SHARPSHOOTING TAPERED END

BACKGROUND OF THE INVENTION

The present invention relates to a nail gun, and more particularly, to the nail gun electrically or pneumatically operated for providing a fine appearance on a workpiece after nail fastening.

Attachment members or finishing materials for use in a baseboard for trimming purposes or for a verandah running on more than two sides of a house or room are adhesively fixed to a wall, and then fixed by fasteners such as nails. A groove having a predetermined small width such as from 3.5 to 7 mm is formed in the attachment member, and the nails are driven into the groove. The nails have a head portion whose color is selected to be in conformance with the external color of the attachment member. Further, the head portion of the nail has a small diameter, so that the head portion can be positioned onto a bottom of the small width groove in an attempt to obtain good external appearance on the attachment member without any scratches as bruises after the nail driving.

As shown in FIGS. 1 and 2, a conventional nail gun includes a main body 1 and a contact arm 5 having a tapering end portion 5A adapted to be in pressure contact with a workpiece such as the attachment member 9. The contact arm 5 has another end portion 5B adapted to push a trigger plate 3A. A valve plunger 4 can be pushed up upon manipulation of a trigger 3 as far as the trigger plate 3A is in the pushed up position. The contact arm 5 is normally biased by a spring 6 toward the attachment member 9. That is, the contact arm 5 is movable relative to the main body 1. When the contact arm 5 and the trigger 3 are both operated, a nail driving operation can be started.

The tapering end portion 5A has an accurate and thin tip end so that it can be positioned onto the bottom of a narrow groove 91 of the attachment member 9. The tapering end portion 5A can serve for sharpshooting the nail to a desired location, since the nail is driven in a direction along a length of the tapering end portion 5A.

The conventional nail gun is also provided with a nose portion or bit guide 7 positioned in side by side relation to the contact member 5. The nose portion 7 is formed with a nail supply passage 7*a* and an injection passage 75 in communication therewith. Alternatively, the injection passage 75 can be formed at a boundary between the contact arm 5 and the nose portion 7. A drive bit (not shown) can pass through the injection passage 75. Upon driving the drive bit, the nail passes through the injection passage 75 and is driven into the attachment member 9.

A magazine 2 is provided for accommodating a plurality of nails 8. Further, a spring-biased feeder (not shown) is provided in the magazine 2 for feeding the nails 8 to the nail supply passage 7*a*. The contact arm 5 directly receives the biasing force of the feeder.

If the tapering end portion 5A is pressed onto the attachment member 9 against the biasing force of the spring 6, the contact arm 5 is moved relative to the main body 1, so that the other end portion 5B of the contact member 5 pushes the trigger plate 3A upwardly. By pressing the trigger 3, the valve plunger 4 is moved, so that compressed air is supplied into a cylinder (not shown) through a trigger valve (not shown) so as to drive the drive bit toward the attachment member 9, to thus drive the nail into the attachment member 9.

The total thickness of the tip of the nose portion 7 and the tip of the tapering end portion 5A must be as small as possible, so that these tips can be positioned in the narrow groove 91. On the other hand, these tips must have a sufficient thickness for providing a given mechanical strength. In considering these conflicting requirements, the total thickness of these tips is selected to be about 4 mm. If the width of the groove 91 is smaller than the total thickness, the conventional nail gun is not available, and instead, a punch must be used.

If the tip end face of the tapered end portion 5A and the tip end face of the nose portion 7 can be positioned in the groove 91, the nail 8 can be accurately driven into the groove 91. On the other hand, if the width of the groove 91 is approximately equal to the total thickness of the tip ends, or is smaller than the total thickness, the nail may not be driven into the groove area but is driven into an improper portion of the attachment member 9.

Nail driving is repeatedly and rapidly performed with short intervals, since a great number of nails must be driven. An operator uses the tip end of the tapering end portion 5A to aim the nails. When performing rapid nails driving, the operator may inadvertently insert only the tip end of the tapering end portion 5A into the narrow groove 91. That is, only the tapering end portion 5A reaches the groove bottom, whereas the tip end of the nose portion 7 is positioned outside of the groove 91 as shown in FIG. 2. If nail driving is performed in such a condition, the nail head may not be positioned onto the groove bottom.

Further, in such a conventional nail gun, its center of gravity is positioned on or around the trigger lever 3. During nail driving, the nail gun may jump up due to the reaction force, and the gun may be urged to rotate about its center of gravity, so that the tip of the nose portion 7 may be offset frontwardly as shown by an arrow A in FIG. 1. Thus, the downwardly moving drive bit may become offset from the nail 8, and hit the surface of the attachment member 9. Even though the tapering end portion 5A is urged downwardly (toward the attachment member) by the biasing force of the spring 6 in spite of the upward movement or jumping of the gun, the nose portion 7 is moved upwardly by the reactive force, and further, the tip portion of the gun is rotated in the direction A. Consequently, the driven nail 8 is not properly aligned with or positioned in the injection passage 75 but becomes offset therefrom. Accordingly misalignment occurs between the nail and the drive bit. Thus, the surface of the attachment member 9 is spoiled with a bruise, and the nail 8 is insufficiently driven.

Furthermore, there is a probability that the end face of the tapering end portion 5A may not reach the groove bottom if the groove 91 is deeply formed. In the latter case, the contact arm 5 cannot be moved, i.e., the contact arm cannot be lifted against the biasing force of the spring 6, and therefore, the trigger plate 3A cannot be pushed by the other end portion 5B of the contact arm 5.

To avoid the above-described drawbacks, accurate positioning is required for placing the end face of the tapering end portion 5A and the end face of the nose portion 7 onto the groove bottom to provide a complete preparatory work for trigger manipulation. However, such careful work may lower the nail driving efficiency, and prolong the nail driving work.

Moreover, since the spring-biased feeder in the magazine 2 is urged toward the contact arm 5, and since the contact arm 5 must be movably biased toward the attachment member 9 by the spring 6, the spring 6 must provide greater biasing force, otherwise, the biasing force of the feeder toward the contact arm 5 may restrain the moving force of the contact arm 5 toward the attachment member 9. As a result, the contact arm 5 is urged toward the workpiece surface with excessive biasing force, and therefore, the surface of the groove bottom may be injured. Furthermore, due to the excessive biasing force of the spring 6, greater force is required to move the contact arm 5 against the biasing force of the spring 6. Moreover, if the nail gun is accidentally dropped, the thin tapering end portion 5A may be deformed or broken.

SUMMARY OF THE INVENTION

It is, therefore, an object of the present invention to overcome the above described conventional drawbacks and disadvantages, and to provide an improved nail gun capable of providing a desired finishing appearance after the accurate driving of a nail into a groove of an attachment member while having sufficient mechanical strength capable of withstanding impact forces caused by accidental dropping.

These and other objects of the present invention can be attained by providing a nail gun for driving a nail into an attachment member including a main body, a drive bit, a trigger, a bit guide, a magazine, a contact arm, and a biasing segment. A pressurized fluid is introduced into the main body, and the drive bit is movable in its axial direction and is driven by the pressurized fluid. The trigger is adapted for actuating the drive bit. The bit guide extends from the main body and is formed with an injection passage for guiding travel of the drive bit and for allowing each one of the nails to pass therethrough. The magazine is coupled to the bit guide for accommodating therein a plurality of nails and for feeding the nails toward the bit guide. The contact arm is movably provided to the bit guide and has an upper portion engageable with the trigger for prohibiting nail driving operation. The contact arm has a lower portion abuttable on the attachment member. The biasing segment is adapted for biasing the contact arm toward the attachment member. The lower portion of the contact arm is projected from a lower end of the bit guide and is formed with an injection bore in alignment with the injection passage.

The lower portion of the contact arm is provided with the injection bore in communication with the injection passage. Therefore, only the abutment of the lower portion onto the attachment member, such as a groove bottom of the attachment member, can provide stable nail driving at a proper location. That is, when only the lower end face of the contact arm is pressed against the groove bottom, the upper portion of the contact arm is disengaged from the trigger, so that the nail driving operation is achievable. Upon manipulation of the trigger, the drive bit is moved downwardly in the injection passage and then in the injection bore. Thus, a nail in the injection passage can be driven into the attachment member.

Since only the insertion of the lower portion of the contact arm into the groove of the attachment member can start nail the driving operation, the entire working time can be reduced. Further, even though the nail gun may undergo a displacement force due to the reactive force caused by the nail driving operation, the engagement of the nail with the injection bore can prevent relative displacement, since the lower portion of the contact arm is always urged toward the attachment member by the biasing segment, and since the lower portion of the contact arm surrounds the driven nail partly embedded into the attachment member. Accordingly, the drive bit can hit the head of the nail in spite of the reactive force without a offsetting hit onto a surface of the attachment member. As a result, the attachment member can maintain its initial external appearance without any surface damage.

Further, the lower portion of the contact arm has sufficient mechanical strength because of a tubular arrangement in the first embodiment, and a reinforcing arrangement in the second embodiment. Thus, prolonged service life results.

DETAILED DESCRIPTION OF THE PREFERRED EMBODIMENTS

Figure 1:
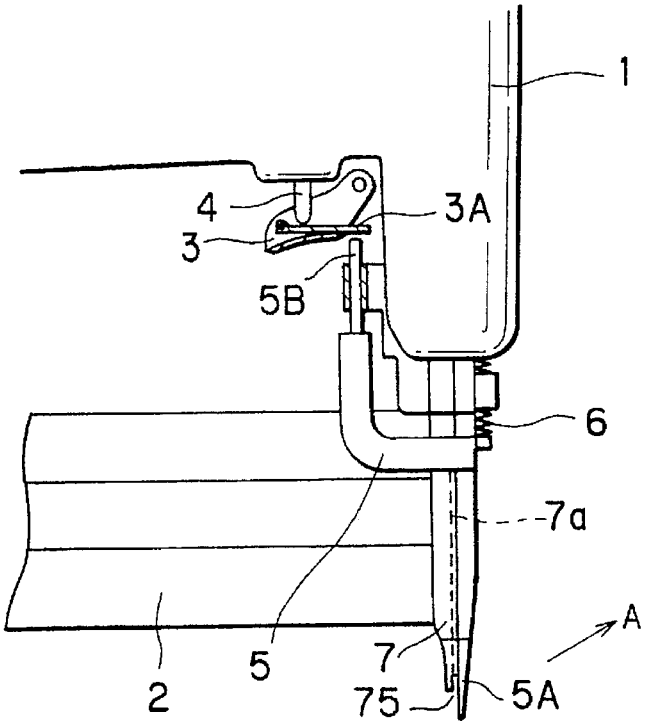
FIG. 1 PRIOR ART
FIG. 1 is a side view showing an essential portion of a conventional nail gun.
Figure 2:
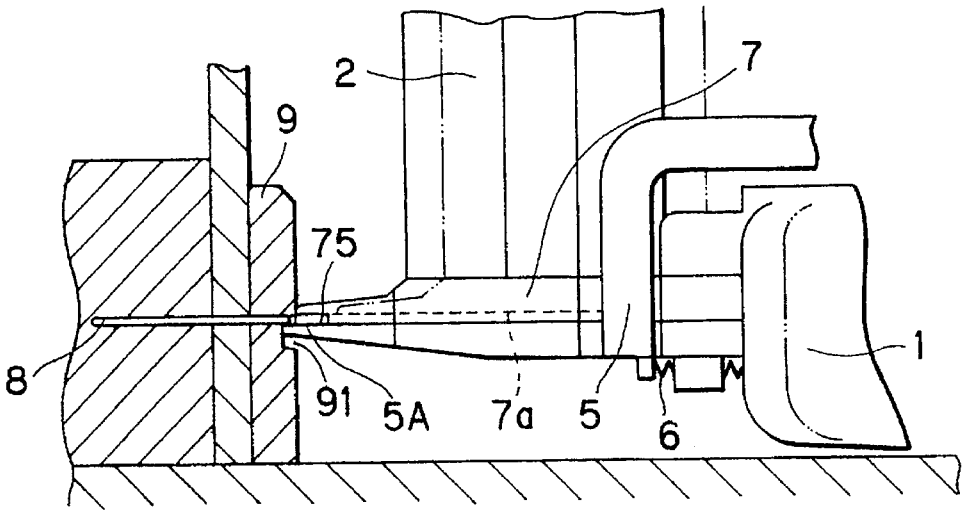
FIG. 2 PRIOR ART
FIG. 2 is a side view showing a nail driving operation in the conventional nail gun.

A nail gun according to a first embodiment of the present invention will be described with reference to FIGS. 3 through 7.

The nail gun includes a main body 1, a magazine 2, a bit guide 12, and a contact arm 50. The magazine 2 is provided for accommodating therein congregated nails 8 in which nails are arrayed side by side and bonded together (In FIG. 3, a single nail 8 is shown for simplicity). A nail feeder 13 is provided in the magazine 2 for feeding and positioning respective ones of the nails to a given position.

The bit guide 12 extends from a lower end of the main body 1, and the magazine 2 is connected to the bit guide 12. The bit guide 12 has a nail supply passage 121 whose bottom is adapted to support a tip end of the nail 8 fed by the feeder 13. Further, an injection groove 122 extending along a length of the bit guide 12 is formed in front of and in communication with the nail supply passage 121 for positioning therein the nail 8 and for allowing a drive bit (not shown) to pass therethrough. The nail feeder 13 is biased by a spring (not shown) toward the bit guide 12, so that the frontmost nail 8 of the nail congregation can be successively positioned in the nail injection groove 122.

The front side of the bit guide 12 is formed with a guide groove 123 extending in parallel with the nail supply passage 121 and the injection groove 122, and the front side of the bit guide 12 is further provided with a projection 124. Female thread 126 is formed in the bit guide 12, and another female thread 127 is formed in the projection 124 of the bit guide 12. Incidentally, the nail supply passage 121 has an upper portion formed with a plurality of irregularities in conformance with the various lengths of the nails. These irregularities are conventional technique as described in Japanese Utility Model Publication No. Sho 53-11432.

The contact arm 50 is movably supported to the bit guide 12. The contact arm 50 has an intermediate sliding portion slidingly movable with respect to the front surface of the bit guide 12, a tapering end portion 51 positioned below the bit guide 12 and provided integrally with the intermediate sliding portion, and an upper portion 52 provided integrally with the intermediate sliding portion. The intermediate sliding portion includes a guide extension 53 slidingly engageable with the guide groove 123. Further, the intermediate sliding portion is formed with a slot 54 engageable with the projection 124. Thus, contact arm 50 is movable within a stroke of the slot 54 in a vertical direction.

A biasing spring 6 is interposed between the bit guide 12 and the intermediate sliding portion, so that the contact arm 50 is normally biased downwardly (toward the attachment member 9). Thus, the main body 1 can be moved toward and away from the attachment member 9 while the tip end face of the tapering end portion 51 is in contact with the attachment member 9 against and by the biasing force of the coil spring 6.

Figure 7:
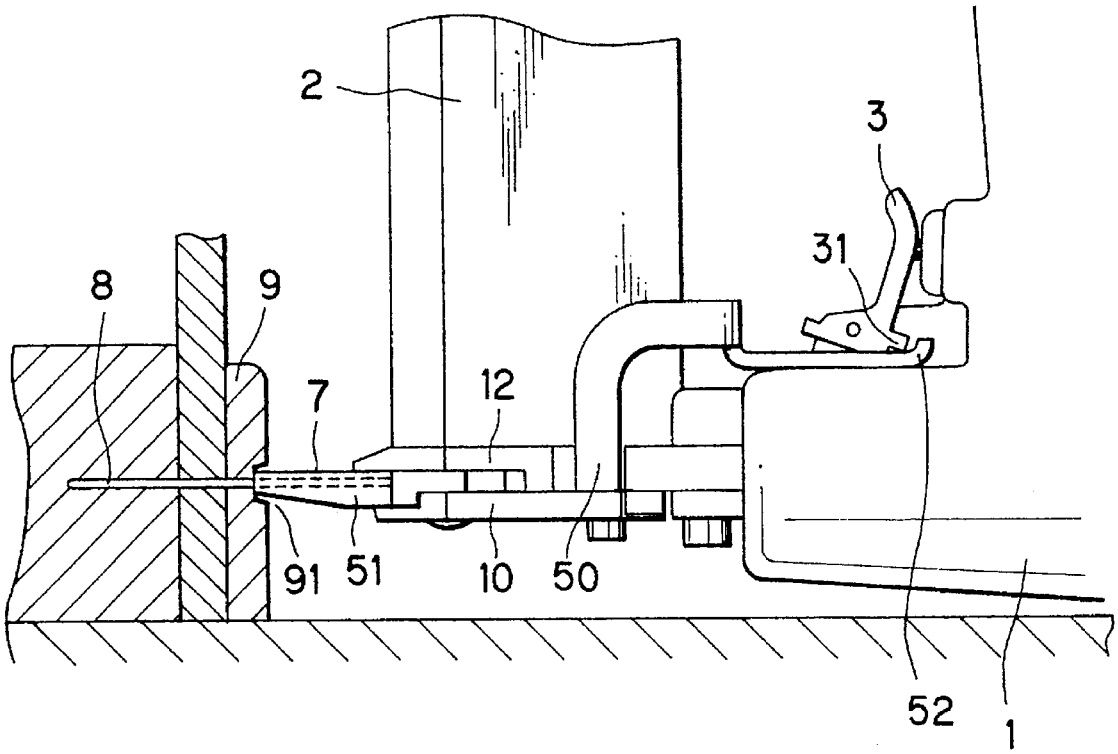
FIG. 7 is a side elevational view showing a nail driving operation in the first embodiment.

The tapering end portion 51 has a configuration in which a width becomes gradually smaller toward its tip end. The tapering end portion 51 is positioned to protrude from the lower end of the bit guide 12, and the thickness of the tip end is about 3.5 mm. Thus, the tapering end portion 51 can solely be positioned into the narrow groove 91 of the attachment member 9 as shown in FIG. 7. The tapering end portion 51 is formed with an injection bore 55 along its length and provided in alignment with the injection groove 122. That is, the injection bore 55 is provided within the tapering end portion 51. The tip end face of the tapering end portion 51 is of a planar shape with an outlet of the injection bore 55 being open.

Figure 3:
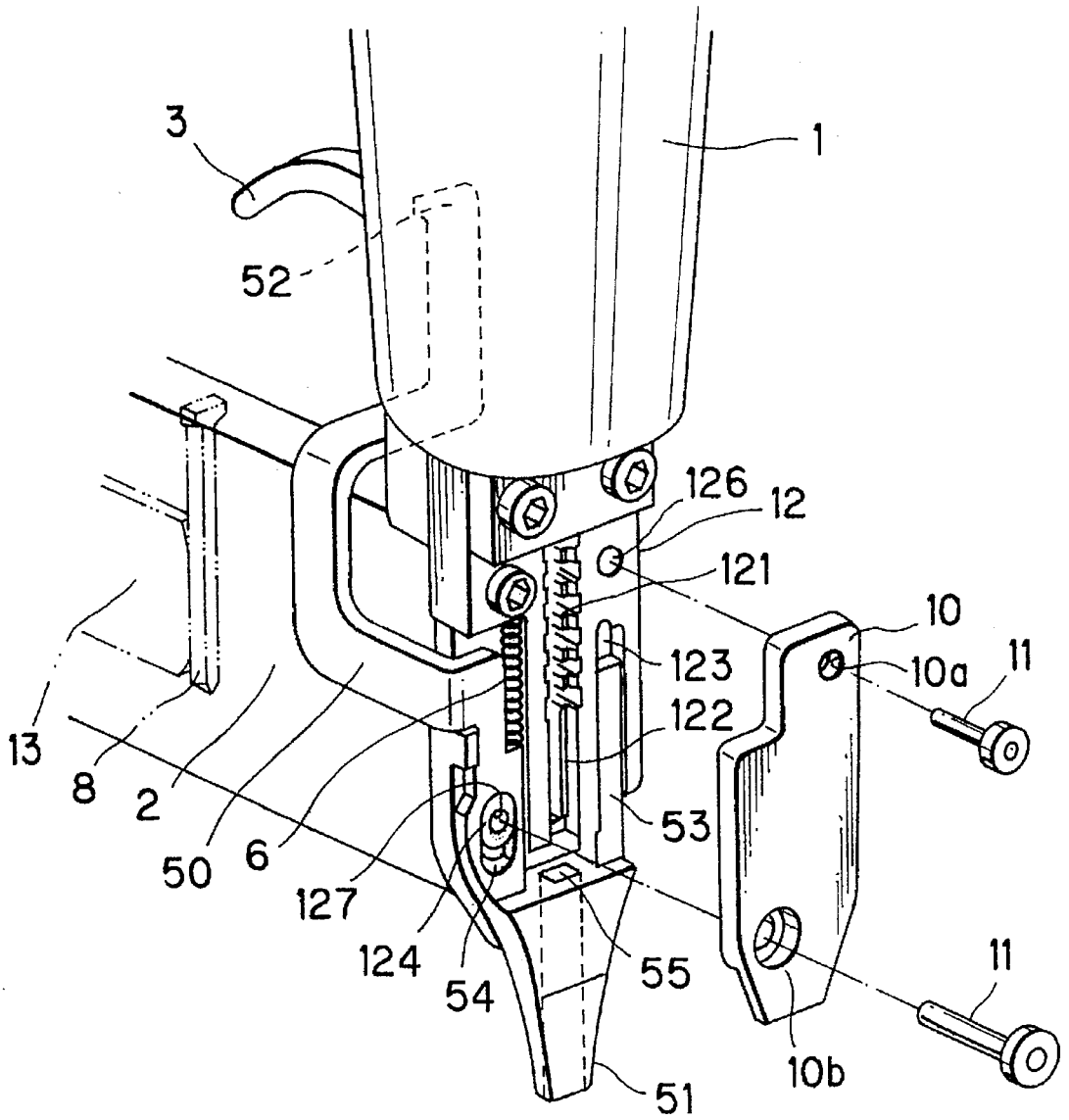
FIG. 3 is an exploded perspective view showing an essential portion of a nail gun according to a first embodiment of the present invention.
Figure 4:
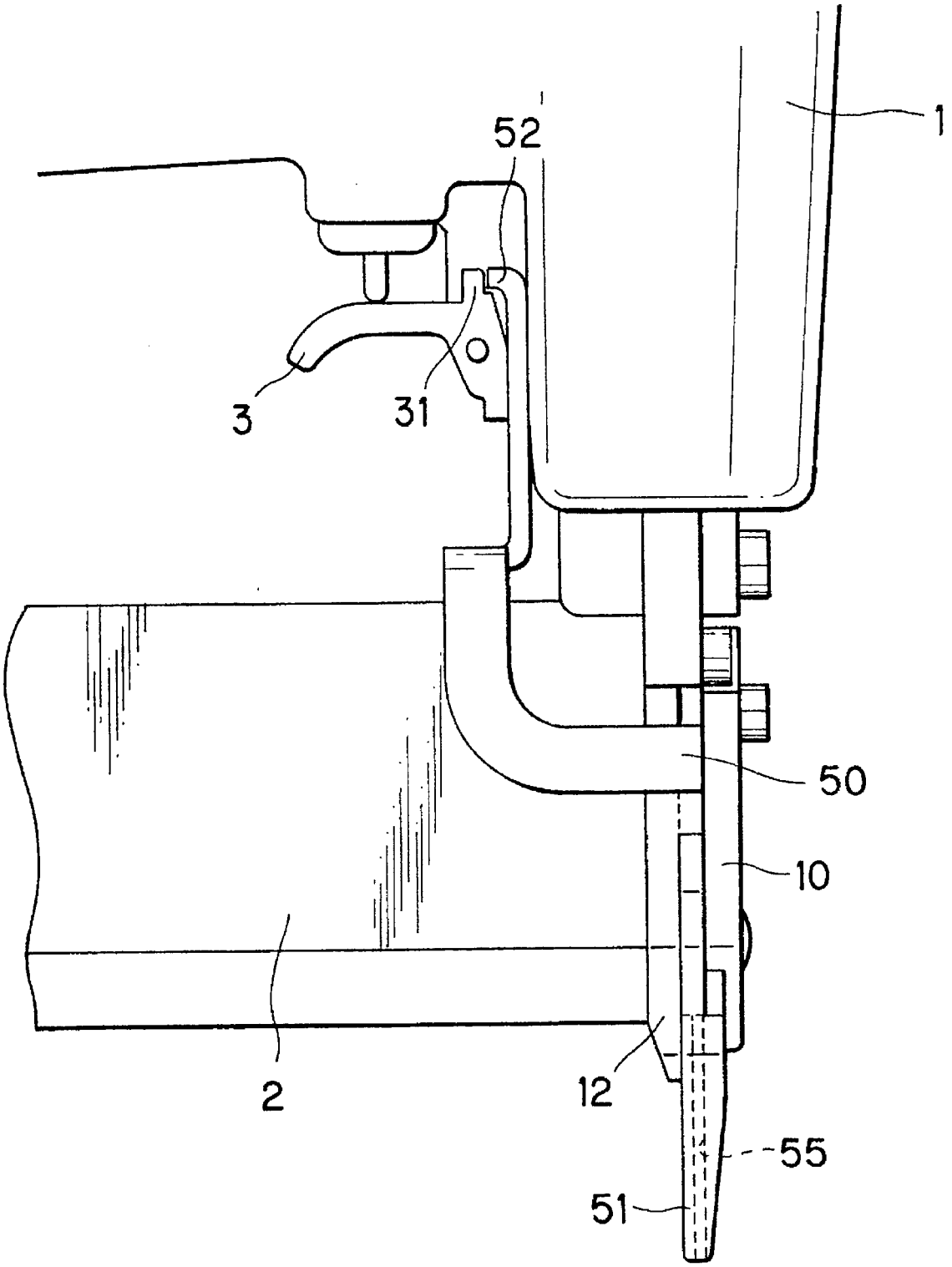
FIG. 4 is a side view showing the essential portion of the nail gun according to the first embodiment.
Figure 5:
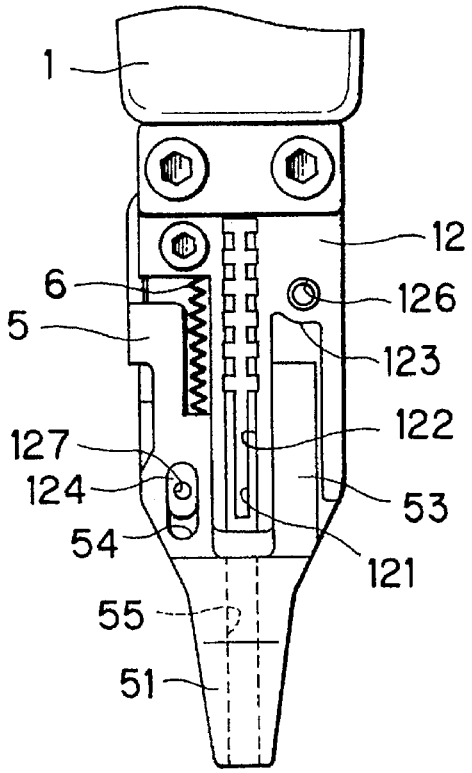
FIG. 5 is a front view showing the essential portion of the nail gun in which a cover is removed to show the internal positional relation when a contact arm is urged in one direction by a biasing force of a spring according to the first embodiment.
Figure 6:
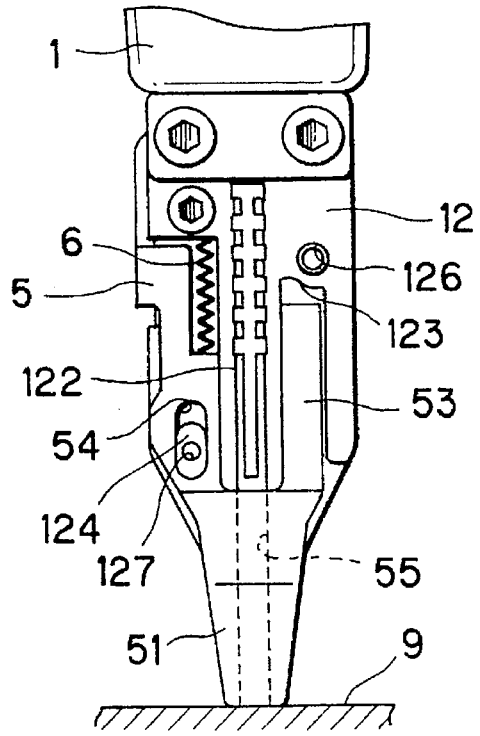
FIG. 6 is a front view showing the essential portion of the nail gun with the cover being removed to show the internal positional relation when the contact arm is moved in an opposite direction against the biasing force of a spring according to the first embodiment.

The upper portion 52 of the contact arm 50 extends to a trigger 3. The trigger 3 has a protrusion 31 to which an end of the upper portion 52 is abuttable. If the tip end of the tapering end portion 51 is not pressed against the attachment member 9, the contact arm 50 is in a lower position as shown in FIGS. 3, 4, and 5, by the biasing force of the spring 6. In this case, the tip end of the upper portion 52 is in abutment with the protrusion 31. Therefore, pivotal movement of the trigger 3 can be restrained. On the other hand, if the tip end of the tapering end portion 51 is pressed against the attachment member 9, the contact arm 50 is moved upwardly relative to the main body 1 against the biasing force of the coil spring 6 as shown in FIGS. 6 and 7. Thus, the tip end of the upper portion 52 is disengaged from the protrusion 31 to allow the trigger 3 to be manipulatable. Incidentally, this safety mechanism can be replaced by the conventional arrangement having the trigger plate 3A shown in FIG. 1.

A cover plate 10 is provided to cover the front surface of the bit guide 12. That is, the nail supply passage 121, the injection groove 122, the guide groove 123, the guide extension 53 and an inlet end of the injection bore 55 are covered by the cover plate 10. The cover plate 10 has holes **10*a*, 10*b* through which screws 11, 11 are inserted. These screws 11, 11 are threadingly engageable with the female threads 126 and 127 of the bit guide 12. Thus, the cover plate 10 is fixedly secured to the bit guide 12**.

The nails in the magazine 2 are urged, by the nail feeder 13, toward the cover plate 10 through the nail supply passage 121 and the injection groove 122. In other words, no direct urging force from the nail feeder 13 is applied to the contact arm 50. Therefore, the biasing force of the spring 6 can be set to a low level regardless of the biasing force of the nail feeder 13. Accordingly, any surface injury on the attachment member 9 can be minimized. This reduction in injury is also attributed to the planar surface of the tip end of the tapering end portion 51.

In the above embodiment, the nail can be surely driven within an area of the narrow groove 91 by mere insertion of only the tapering end portion 51 of the contact arm 50 into the groove 91. Accordingly, any damage to the surface of the attachment member 9 is avoidable. Smooth placement of the tapering end portion 51 can speed up the nail driving work in which a great number of nails can be driven within a shortened period of time.

Since only the tapering end portion 51 of the contact arm 50 is to be inserted into the groove 91 in comparison with the insertion of both the contact arm tip and the nose portion as seen in the conventional nail gun, sharpshooting can be promptly achieved.

Further, because of the tubular arrangement of the injection bore 55, i.e., the injection bore 55 is provided within the tapering end portion 51 only, the mechanical strength of the tapering end portion 51 can be enhanced.

Further, similar to the conventional device, the main body 1 of the nail gun is lifted up due to reaction forces generated during the nail driving operation, and the nail gun may be urged to be rotated about its center of gravity, so that the tip end of the tapering end portion 51 is urged to be moved frontwardly. However, since the tapering end portion 51 itself defines the injection bore 55 without co-operation with the bit guide 12, the engagement between the injection bore 55 and the driven nail 8, which has been partly thrusted into the wall by the drive bit, is still maintained, because the tapering end portion 51 is also urged downwardly by the spring 6. Thus, the frontward movement of the tapering end portion 51 is restrained by the head portion of the driven nail 8. Accordingly, alignment between the nail 8 and the drive bit is still maintainable even after the upward lifting of the nail gun, so that the drive bit can surely impact the nail head while avoiding direct impact onto the attachment member 9 surface by the drive bit.

Figure 8:
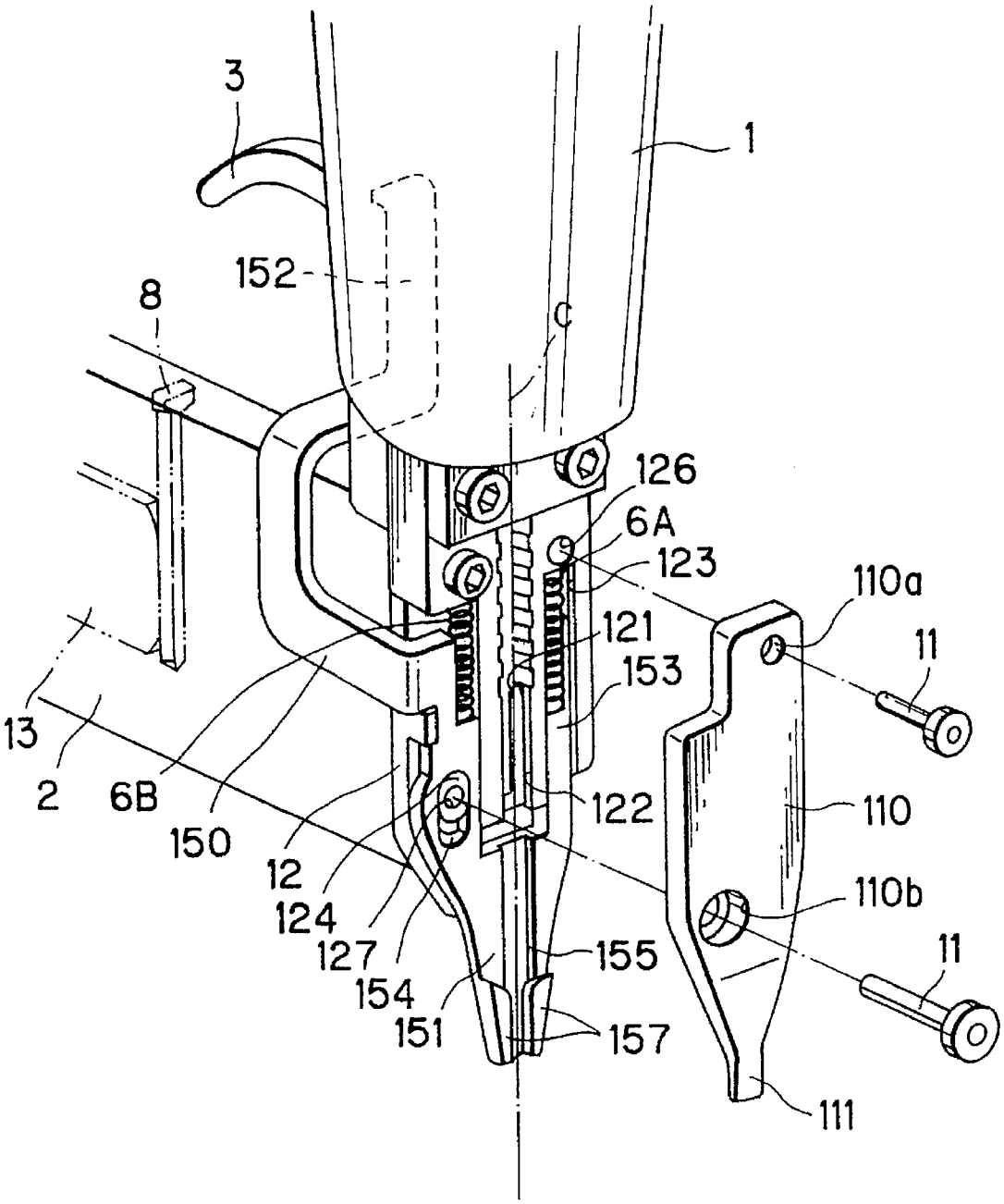
FIG. 8 is an exploded perspective view showing an essential portion of a nail gun according to a second embodiment of the present invention.
Figure 9:
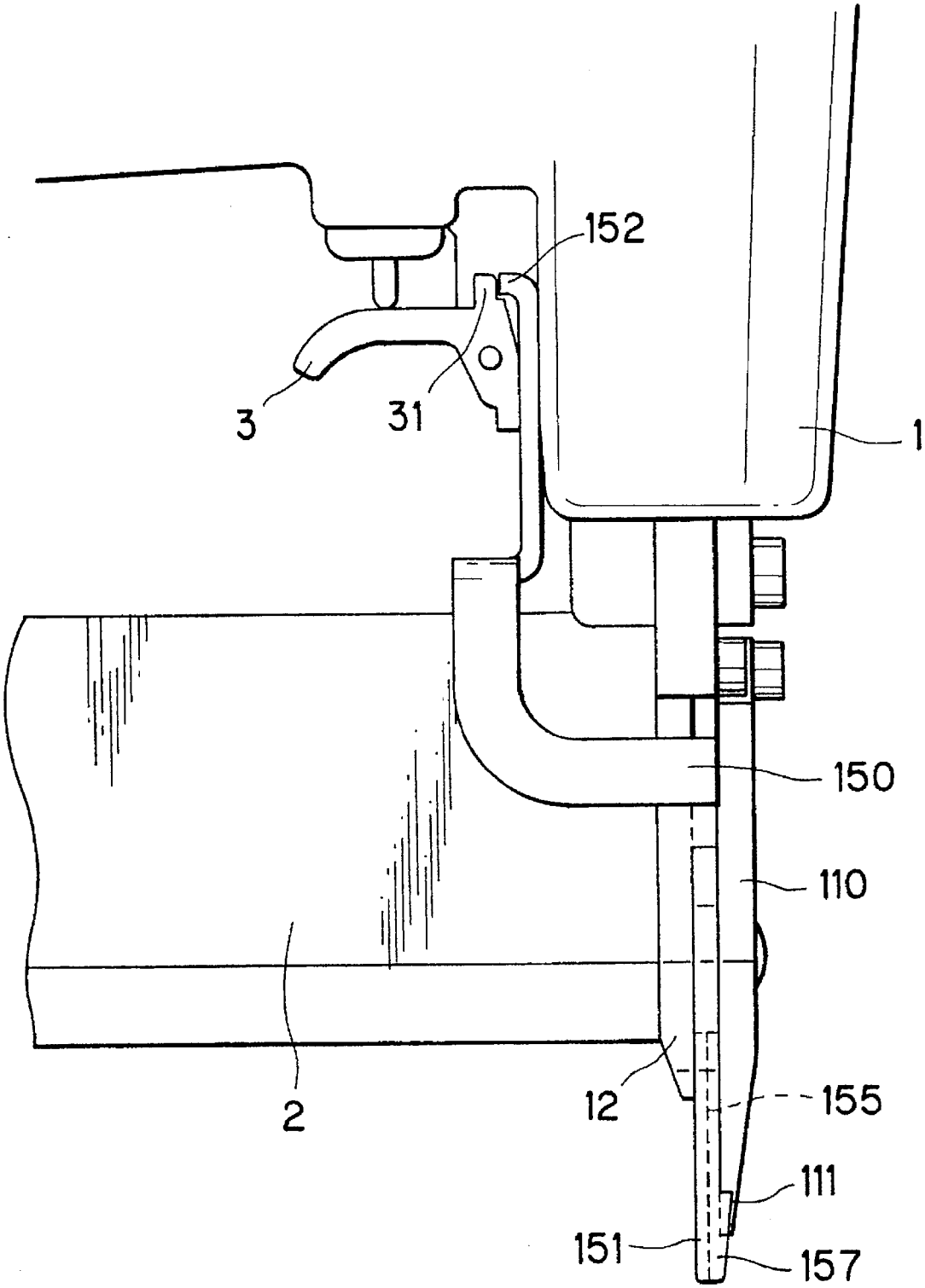
FIG. 9 is a side view showing the essential portion in the second embodiment.

A nail gun according to a second embodiment of the present invention will next be described with reference to FIGS. 8 and 9. The second embodiment pertains to an improvement on the first embodiment with respect to facilitation in manufacture and maintenance of the contact arm. That is, in the first embodiment, the tapering end portion 51 of the contact arm 50 is manufactured by welding. The welding accompanies difficulty in manufacture, and increases production cost with unstable product quality. Further, the injection bore 55 in the first embodiment is of tubular shape, and therefore, if a nail is clogged therein, it would be rather difficult to remove the clogged nail from the tubular passage. Improvement is made on these aspects in the second embodiment.

A tapering end portion 151 of the second embodiment does not provide the bore-shaped injection passage but provides an injection groove 155 similar to the injection groove 122 in the bit guide 12. Further, a pair of projections 157 are provided at the front surface of the extreme end portion. Further, two biasing springs 6A and 6B are provided at symmetrical positions with respect to a center line C so as to minimize inclination of the contact arm 150 and to provide smooth vertical movement of the contact arm 150.

To this effect, a stepped portion is provided in the guide extension 153 so as to seat one end of the biasing spring 6A. Since no tubular portion is provided in the contact arm 150, the contact arm 150 can be integrally manufactured by molding, such as by a lost wax method.

A cover plate 110, similar to the plate 10 is provided to cover the front surfaces of the bit guide 12 and the tapering end portion 151. A small width portion 111 is provided at a tip end of the cover plate 110. The small width portion 111 can be positioned between the pair of projections 157 and 157 so as to reinforce the extreme end of the contact arm 150. Incidentally, reference numeral 154 designates a guide slot, similar to the guide slot 54 of the first embodiment.

Thus, the second embodiment provides advantages similar to that of the first embodiment. Further, in the second embodiment, the contact arm 150 can be manufactured easily, and a nail clogged in the injection passage defined by the injection groove 155 and the cover plate 110 can be easily removed by detaching the cover plate 110 from the bit guide 12. Further, the outlet end of the injection passage 155 is reinforced by the pair of projections 157 and the small width portion 111. Incidentally, since the injection groove 155 formed in the tapering end portion 151 is closed by the cover plate 110, the resultant injection passage 155 becomes a bore shape.

While the invention has been described in detail and with reference to specific embodiments thereof, it would be apparent to those skilled in the art that various changes and modifications may be made therein without departing from the spirit and scope of the invention.

What is claimed is:

1. A nail gun for driving nails into an attachment member, including:

a main body (1);

a drive bit movable in an axial direction for driving the nails in the axial direction;.

a trigger (3) for actuating the drive bit;

a bit guide (12) extending from the main body (1) and formed with an injection passage (122) for guiding travel of the drive bit and for allowing the nails to pass therethrough;

a magazine (2) coupled to the bit guide (12) for accommodating the nails and for feeding the nails toward the bit guide (12);

a contact arm (50) movably secured to the bit guide and having an upper portion engageable with the trigger (3) and a lower, nose portion (51) abuttable on the attachment member; and a biasing segment (6) for biasing the contact arm toward the attachment member, wherein the lower portion of the contact arm protrudes from a lower end of the bit guide (12) in both fully extended and fully retracted positions of said contact arm and the lower portion is formed with a non-deformable injection bore (55) in alignment with the injection passage (122) for receiving the nails from the injection passage and delivering the nails into the attachment member, wherein the lower, nose portion (51) of the contact arm (50) is tapered, wherein the trigger (3) is movably secured to the main body (1) and is pivotable between first and second pivot positions, and wherein engagement between the trigger and the upper portion of the contact arm (50) prevents manipulation of the trigger (3) at the first pivot position when the contact arm is fully extended by the biasing segment (6), and further wherein the contact arm (50) has an intermediate portion in sliding contact with the bit guide (12), the intermediate portion having an extension (53) extending in parallel with the injection bore (55) and a slot (54) extending in parallel with the injection bore (55), the bit guide (12) having a corresponding guide groove (123) in which the extension (53) is slidably engaged and a projection (124) engageable with the slot (54), the contact arm (50) being movable with respect to the bit guide (12) in the axial direction and within a stroke defined by a length of the slot (54).

2. The nail gun as claimed in claim 1, wherein the bit guide (12) is formed with female threads (126, 127), and further comprising a cover member (10) positioned above the intermediate portion of the contact arm (50), and screws (11) threadingly engageable with the female threads (126, 127) for fixing the cover member (10) to the bit guide (12).

3. The nail gun as claimed in claim 2, further comprising a nail feeder (13) positioned in the magazine (2) for biasing the nails in the magazine toward the cover member (10).

4. The nail gun as claimed in claim 3, wherein the biasing segment (6) is positioned between the intermediate portion of the contact arm (50) and the bit guide (12).

5. A nail gun for driving nails into an attachment member, including:

a main body (1);

a drive bit movable in an axial direction for driving the nails in the axial direction;

a trigger (3) for actuating the drive bit;

a bit guide (12) extending from the main body (1) and formed with an injection passage (122) for guiding travel of the drive bit and for allowing the nails to pass therethrough;

a magazine (2) coupled to the bit guide (12) for accommodating the nails and for feeding the nails toward the bit guide (12);

a contact arm (150) movably secured to the bit guide and having an upper portion engageable with the trigger (3) and a lower portion (151) abuttable on the attachment member; and a biasing segment (6A, 6B) for biasing the contact arm (150) toward the attachment member, wherein the contact arm (150) has an intermediate portion in sliding contact with the bit guide (12), and further comprising a fixed cover member (110) secured to the bit guide (12) and positioned to cover the intermediate portion and the lower portion (151), the lower portion (151) of the contact arm (150) having an injection groove (155) formed on a side of the contact arm (150) opposite the bit guide (12), the injection groove (155) being covered by the cover member (110) to define the injection bore therebetween.

6. The nail gun as claimed in claim 5, wherein the trigger (3) is movably secured to the main body (1) and is pivotable between first and second pivot positions, and wherein engagement between the trigger and the upper portion of the contact arm (150) prevents manipulation of the trigger (3) at the first pivot position when the contact arm is fully extended by the biasing segment (6).

7. The nail gun as claimed in claim 6, wherein the cover member (110) covers the intermediate portion and the lower portion (151) of the contact arm (150), and wherein the cover member (110) has a lowermost small width portion (111), and wherein the lower portion (151) of the contact arm (150) is provided with a pair of projections (157) extending toward the cover member (110) and positioned beside the injection groove (155), the small width portion (111) being engageable between the pair of projections (157) for mechanically reinforcing the lower portion (151).

8. The nail gun as claimed in claim 7, wherein the intermediate portion of the contact arm (150) has an extension (153) extending in parallel with the injection bore (155) and a slot (154) extending in parallel with the injection bore, and wherein the bit guide (12) has a corresponding guide groove (123) in which the extension (153) is slidably engaged and a projection (124) engageable with the slot (154), the contact arm (150) being movable with respect to the bit guide (12) in the axial direction and within a stroke defined by a length of the slot (154).

9. The nail gun as claimed in claim 8, wherein the bit guide (12) is formed with female threads (126, 127), and further comprising screws (11) threadingly engageable with the female threads (126, 127) for fixing the cover member (110) to the bit guide (12).

10. The nail gun as claimed in claim 9, further comprising a nail feeder (13) positioned in the magazine (2) for biasing the nails in the magazine toward the cover member (110).

11. The nail gun as claimed in claim 10, wherein the biasing segment comprises a pair of biasing springs (6A, 6B), one of the biasing springs (6A) being interposed between the guide groove (123) and the extension (153), and the other biasing spring (6B) being positioned symmetrically with the biasing spring (6A) with respect to the injection bore (155).

12. A nail gun for driving nails into an attachment member, each of the nails having a rectangular-shaped head, including:

a main body (1);

a drive bit movable in an axial direction for driving the nails in the axial direction;

a trigger (3) for actuating the drive bit;

a bit guide (12) extending from the main body (1) and formed with an injection passage (122) for guiding travel of the drive bit and for allowing the nails to pass therethrough;

a magazine (2) coupled to the bit guide (12) for accommodating the nails and for feeding the nails toward the bit guide (12);

a contact arm (150) movably secured to the bit guide and having an upper portion engageable with the trigger (3) and a lower portion (151) abuttable on the attachment member; and a biasing segment (6A, 6B) for biasing the contact arm (150) toward the attachment member, wherein the contact arm (150) has an intermediate portion in sliding contact with the bit guide (12), and further comprising a fixed cover member (110) secured to the bit guide (12) and positioned to cover the intermediate portion and the lower portion (151), the lower portion (151) of the contact arm (150) having an injection groove (155) formed on a side of the contact arm (150) opposite the bit guide (12), the injection groove (155) being covered by the cover member (110) to define an injection bore therebetween, the injecting bore having a rectangular cross-section.

* * * * *